US008640891B2

(12) United States Patent
Buttigieg

(10) Patent No.: US 8,640,891 B2
(45) Date of Patent: Feb. 4, 2014

(54) STORAGE CAROUSEL

(76) Inventor: Michael Phillip Buttigieg, Cronulla (AU)

( * ) Notice: Subject to any disclaimer, the term of this patent is extended or adjusted under 35 U.S.C. 154(b) by 77 days.

(21) Appl. No.: 13/138,275

(22) PCT Filed: Mar. 12, 2010

(86) PCT No.: PCT/AU2010/000289

§ 371 (c)(1),
(2), (4) Date: Jul. 26, 2011

(87) PCT Pub. No.: WO2010/102347

PCT Pub. Date: Sep. 16, 2010

(65) Prior Publication Data

US 2011/0315648 A1 Dec. 29, 2011

(30) Foreign Application Priority Data

Mar. 13, 2009 (AU) ..... 2009901086

(51) Int. Cl.
*A47F 3/14* (2006.01)
*A47F 5/02* (2006.01)
*A47F 3/10* (2006.01)

(52) U.S. Cl.
USPC ..... 211/131.1; 211/163; 312/125

(58) Field of Classification Search
USPC ..... 211/53, 56, 58, 70, 78, 95, 107, 115, 211/129.1, 131.1, 133.4, 144, 163, 194, 211/196, 205; 312/125, 135, 305; 108/94, 108/95, 103, 105, 139, 141; 220/23.2, 23.4, 220/23.86, 628, 629, 630, 636
See application file for complete search history.

(56) References Cited

U.S. PATENT DOCUMENTS

| | | | | | |
|---|---|---|---|---|---|
| 727,107 | A * | 5/1903 | Donalson | 211/131.1 |
| 922,888 | A * | 5/1909 | Grunwaldt | 47/14 |
| 969,959 | A * | 9/1910 | Knight | 312/305 |
| 1,347,272 | A * | 7/1920 | Hogg | 211/58 |
| 2,071,290 | A * | 2/1937 | Scriba | 211/58 |
| 2,232,924 | A * | 2/1941 | Miller | 276/44 |
| 2,493,538 | A * | 1/1950 | Karns | 211/129.1 |
| 2,599,802 | A * | 6/1952 | Yzetta | 211/131.1 |
| 2,678,734 | A * | 5/1954 | Karns | 211/58 |
| 2,711,741 | A * | 6/1955 | Wassell | 40/379 |
| 2,750,051 | A * | 6/1956 | Wassell | 108/103 |
| 3,164,259 | A * | 1/1965 | De Caccia | 211/131.1 |
| 4,070,973 | A * | 1/1978 | Morgan | 108/20 |
| 4,079,841 | A * | 3/1978 | Castel | 211/131.1 |
| 4,126,366 | A * | 11/1978 | Handler et al. | 312/249.2 |
| 4,700,850 | A * | 10/1987 | Morgan et al. | 211/131.1 |
| 4,736,856 | A * | 4/1988 | Alneng et al. | 211/131.1 |
| 4,838,625 | A * | 6/1989 | Taylor | 312/249.5 |
| 4,884,713 | A * | 12/1989 | Handler | 220/23.4 |
| 6,206,493 | B1 * | 3/2001 | Sanchez-Levin et al. | 312/125 |
| 2008/0196634 | A1 * | 8/2008 | Pueyo et al. | 108/106 |
| 2009/0178989 | A1 * | 7/2009 | Accuardi | 211/126.7 |

* cited by examiner

*Primary Examiner* — Joshua Rodden
(74) *Attorney, Agent, or Firm* — Jacobson and Johnson; Thomas N. Phung

(57) ABSTRACT

A storage carousel is disclosed which includes multiple vertically displaced carousel frames (1) independently rotatable on a common axis (6). Each of the carousel frames has ridges (5) for removable mounting a plurality of storage bins (9, 10, 11 and 12) in side-by-side relationship for access by a user.

2 Claims, 7 Drawing Sheets

STORAGE CAROUSEL

FIELD OF THE INVENTION

This invention relates to storage apparatus. More particularly although not exclusively it discloses an improved space efficient stand for storage bins.

BACKGROUND TO THE INVENTION

Existing storage bins, such as for example "Dexion" type bins, are normally mounted on racks against a wall or other fixed surface. Such arrangement is not spatially efficient as access room has to be maintained around all sides of the rack to reach each bin. Also persons wishing to access the contents of various bins have to continually move across the fixed rows of racks.

SUMMARY OF THE INVENTION

It is therefore an object of this invention to ameliorate the aforementioned disadvantages and accordingly a storage apparatus is disclosed which includes multiple vertically displaced carousels independently rotatable on a common axis, each of said carousels having means for removably mounting a plurality of storage bins in side-by-side relationship for access by a user.

Preferably said means for mounting said storage bins comprises a ridge or upstanding edge of a carousel frame which engages in slots on said bins.

It is further preferred that said carousel frame is rectangular with a central hub to receive said axis.

It is further preferred that said bins are arranged adjacently along sides of said carousel frames.

It is further preferred that said carousel frame includes turning handles extending out from the corners of said frame.

It is further preferred that said carousels are adapted to mount a range of sizes of said bins.

BRIEF DESCRIPTION OF THE DRAWINGS

One preferred embodiment of the invention will now be described with reference to the attached drawings in which:—

DETAILED DESCRIPTION OF THE PREFERRED EMBODIMENTS

Figure 1:
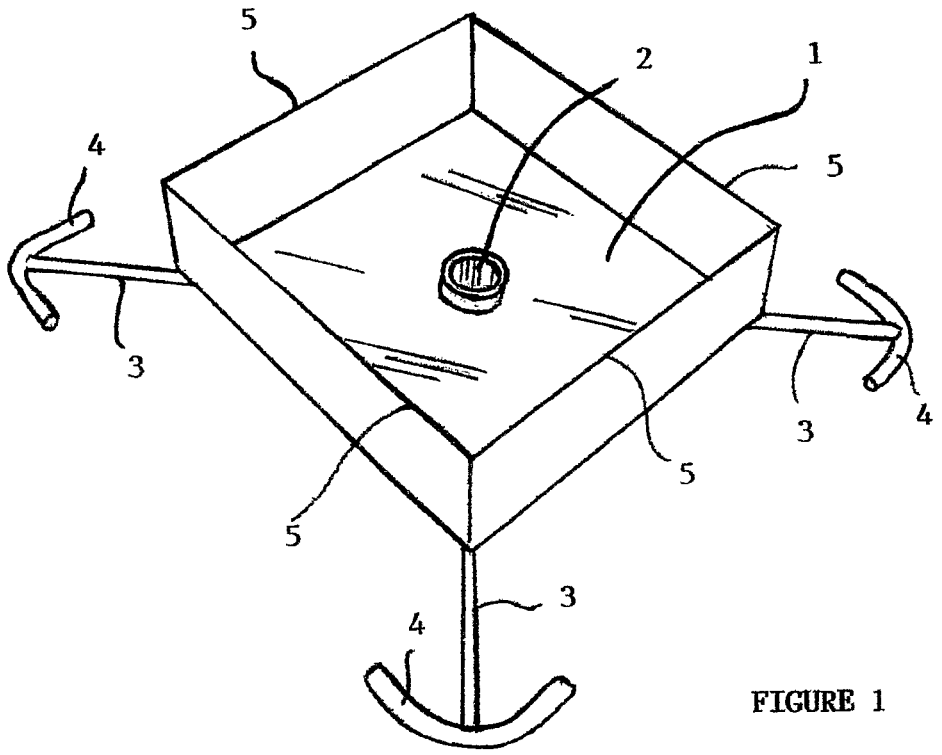
FIG. 1 is a schematic perspective view of a rotatable carousel frame for a storage apparatus according to a first embodiment of said invention.

Referring first to FIG. 1 the carousel frame may comprise a rectangular sheet metal box-like structure 1 with a central hub 2 and arms 3 with handles 4 extending out from the corners. The edges of the frame are defined by upstanding ridges 5 along each side. As described later the size of the ridges 5 may vary in height in accordance with the storage bins to be fitted.

Figure 2:
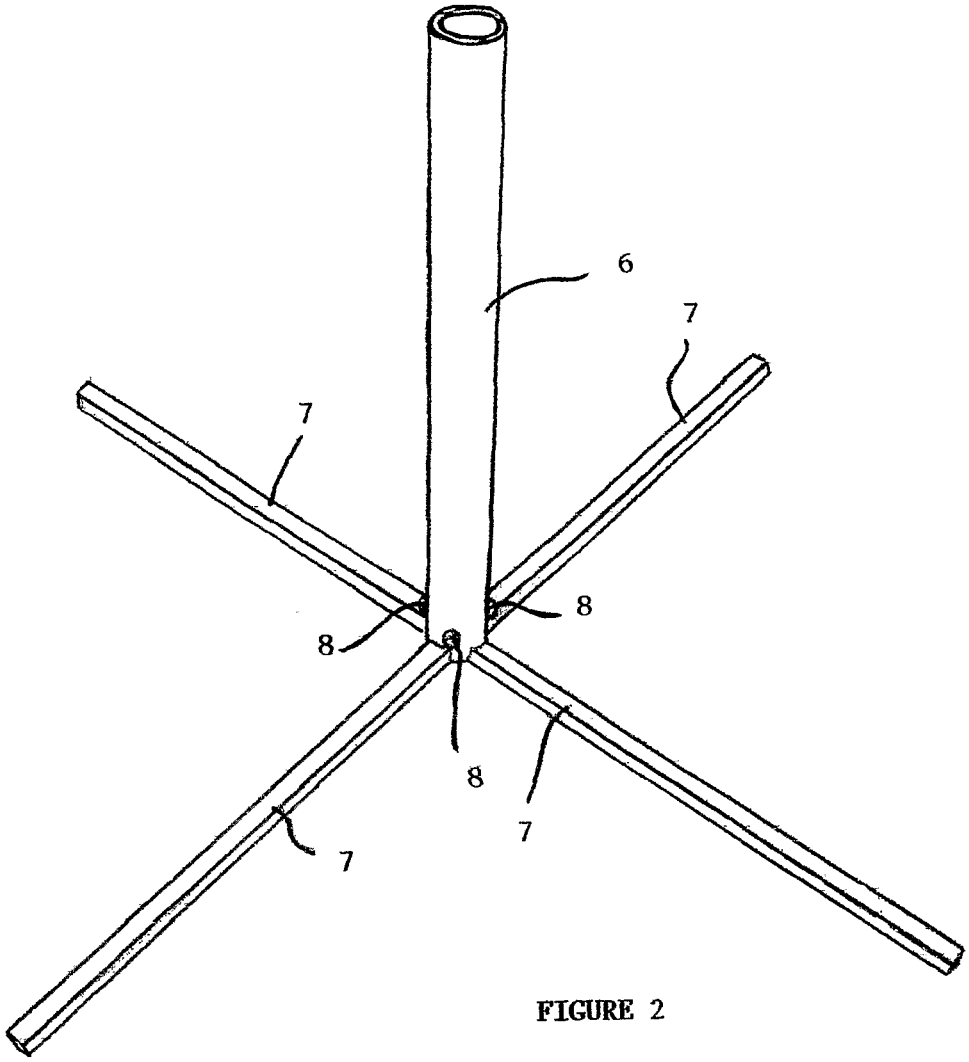
FIG. 2 is a schematic perspective view of a vertical stand for the carousel frame of FIG. 1.
Figure 3:
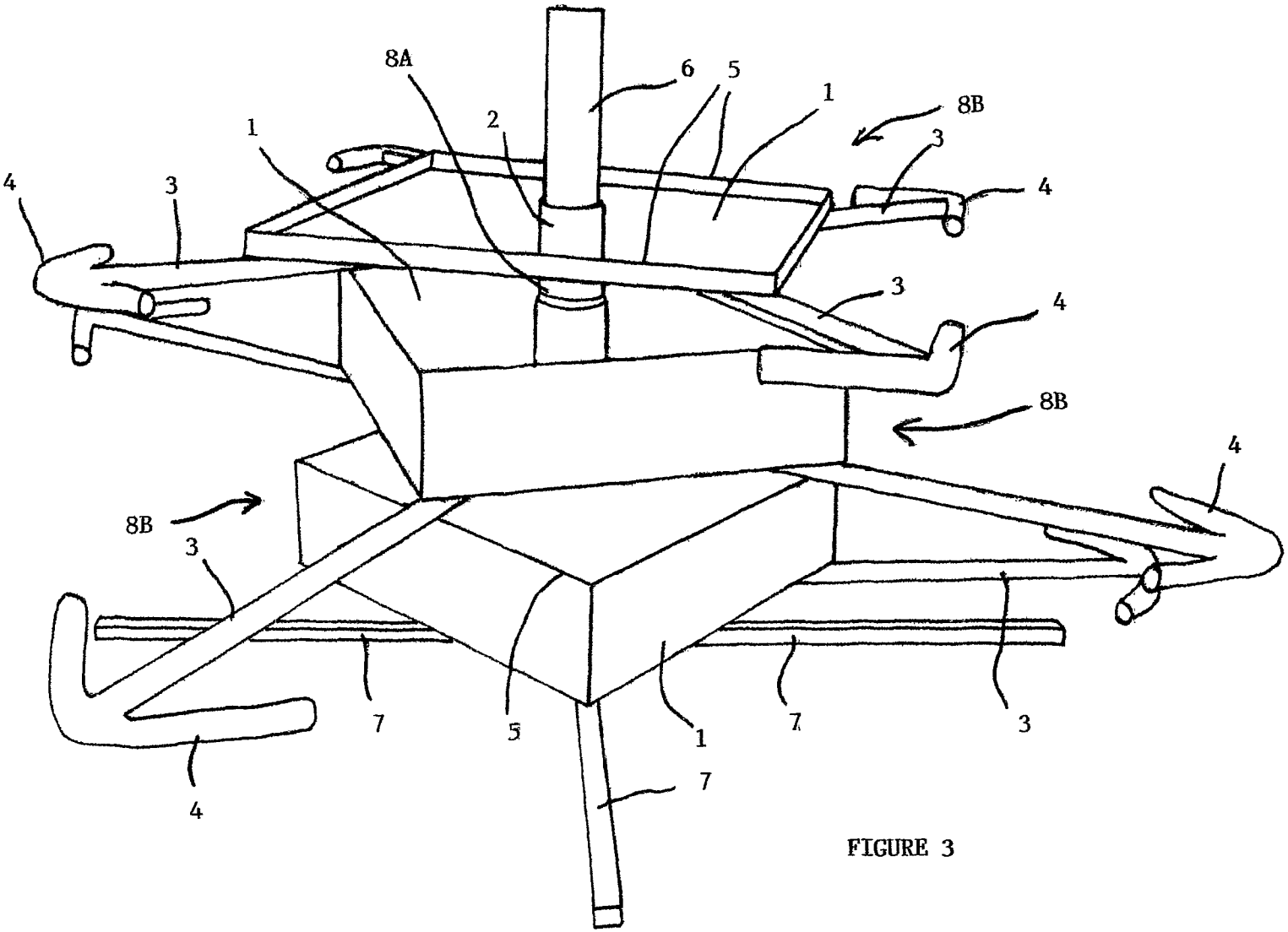
FIG. 3 shows a plurality of different sized carousel frames rotatably mounted on the stand of FIG. 2.

In use the carousel frame 1 is rotatably mounted on a base comprising an upright axis 6 and horizontal stabilising arms 7 as shown in FIG. 2. The hub 2 is fitted over the axis 6 with the two components being sized so that the carousel frame is held in a horizontal configuration but is still able to rotate freely about said axis on rollers 8. With the addition of suitable low friction spacer rings or bearings 8A between them a series of independently rotatable carousel frames 8B can thus be mounted, one above the other, on the axis 6 as shown in FIG. 3. These carousel frames preferably decrease in size from the bottom to the top of the axis.

Figure 4:
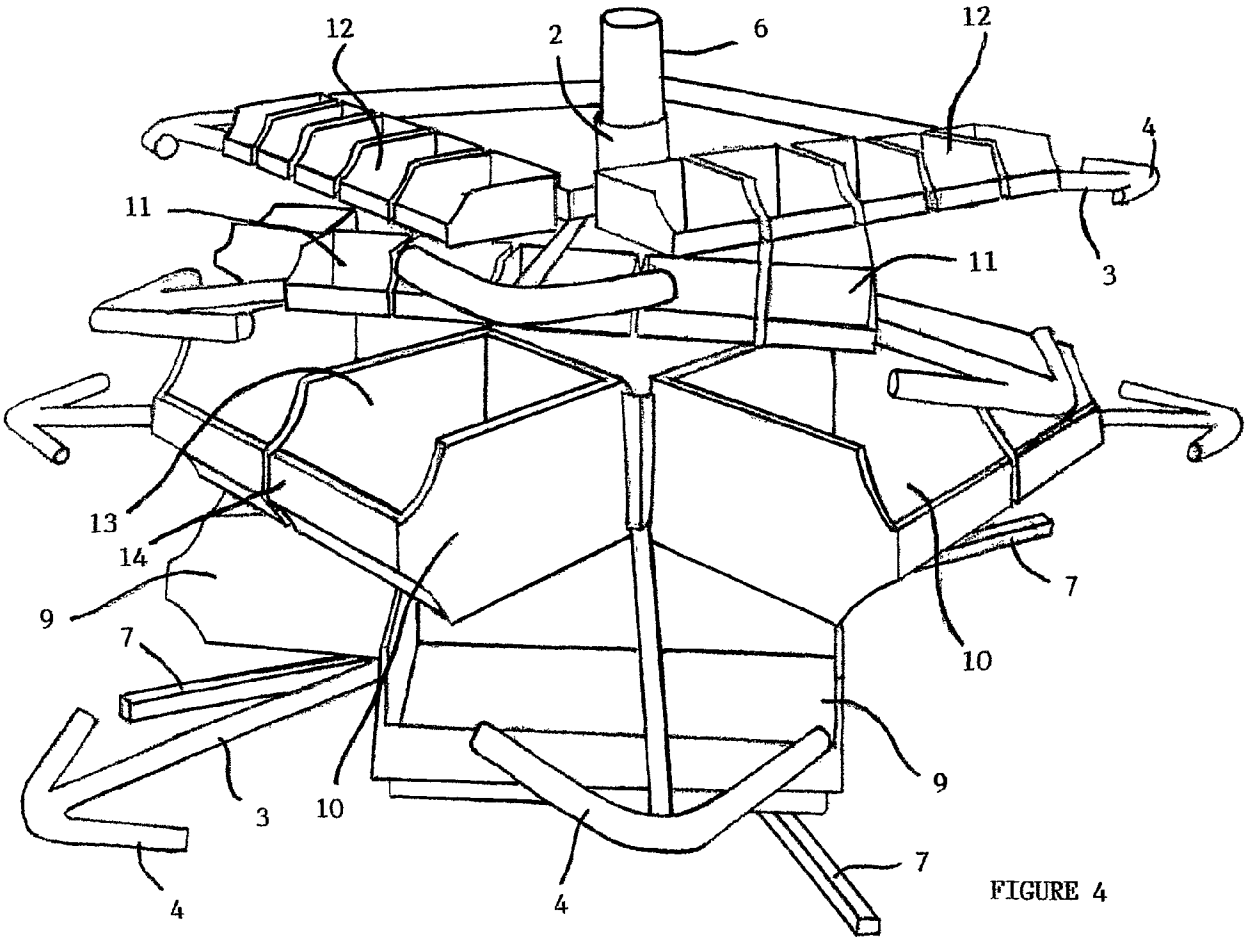
FIG. 4 shows the carousel frames with attached bins.

As best shown in FIGS. 3 and 4 the frame with the highest ridge 5 is, with this embodiment, located at the bottom where it mounts the largest bins 9 around the periphery. Successively higher carousels may be reduced in size and adapted to mount smaller bins 10, 11 and 12.

Figure 5:
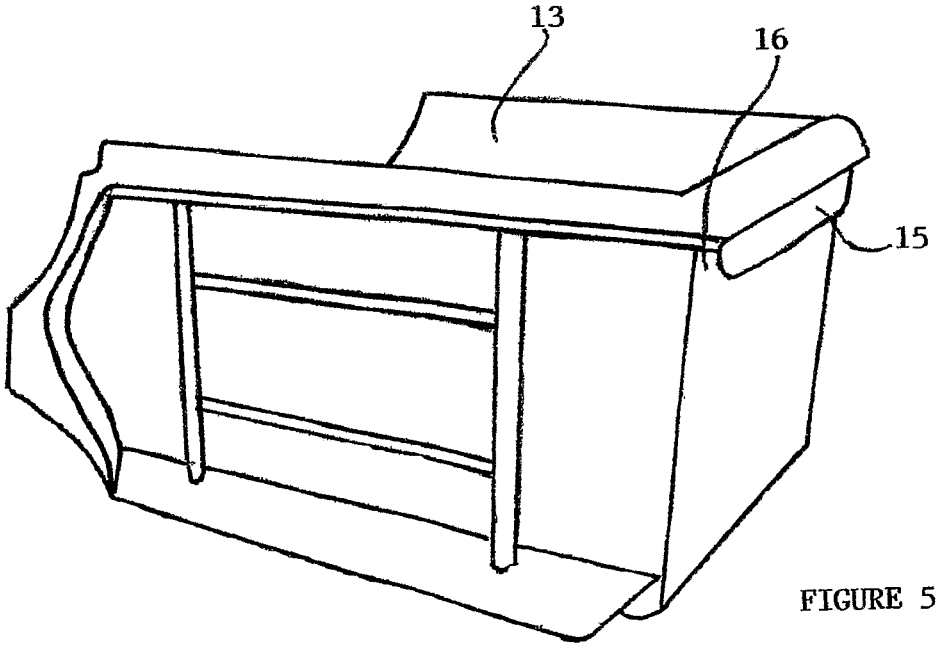
FIG. 5 shows an example of a bin for use with the carousel frames.

The currently preferred form of bin is best shown schematically in FIG. 4 from the front and in FIG. 5 from the rear. It may comprise an open top 13 which slopes down to a low front panel 14 to thereby form a storage container for small items which is easily accessed by a user. The bin is also formed with downwardly extending tongue 15 across the upper back panel. This tongue forms a slot 16 which engages the aforementioned side ridges of the carousel frames so that a series of bins can be mounted side-by-side as shown in FIG. 4. With this embodiment the largest bins are located on the lowermost frame. They decrease progressively in size toward the top. Each carousel frame is also independently rotatable using the aforementioned handles 4. This reduces space requirements and enables a user to easily access all bins from the one location.

Figure 6:
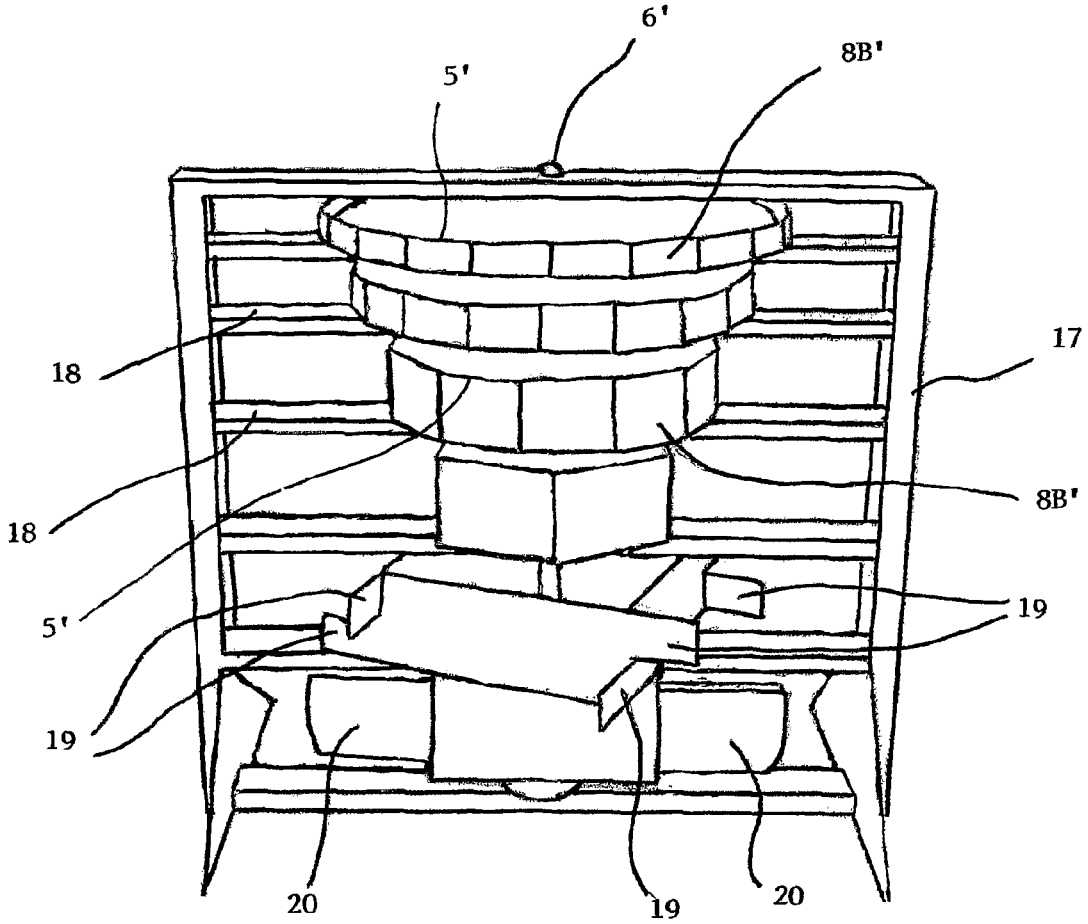
FIGS. 6 and 7 show a second embodiment of the invention.
Figure 7:
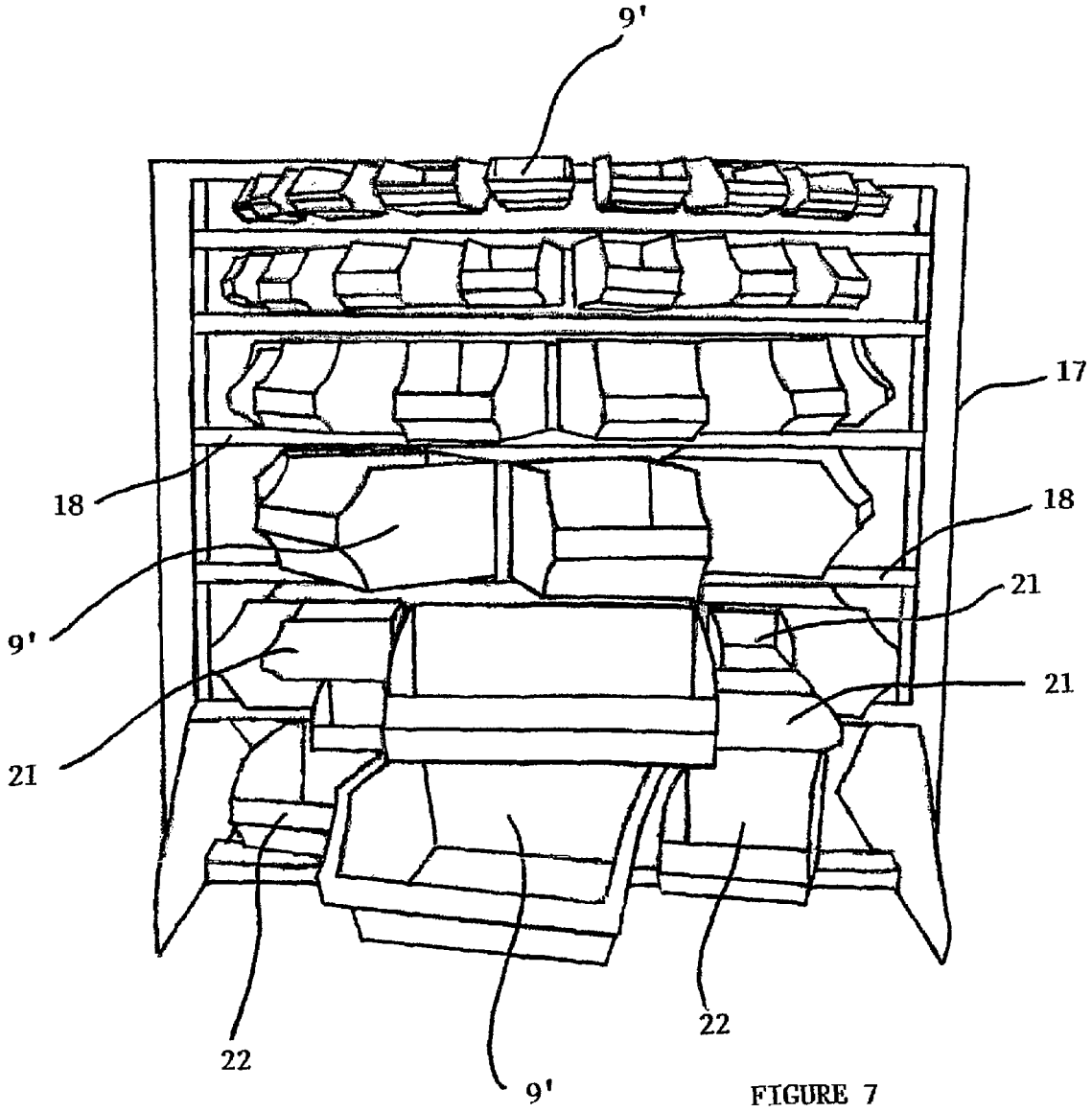

With the second embodiment of the invention shown in FIGS. 6 and 7 the main components which correspond in function to those of the first embodiment are identified by the same numbers which however are primed (') to distinguish them. There is an upright rectangular sheet metal frame 17 with horizontal spaced apart support members 18. A vertical axis 6' extends the height of the frame 17 and passes through each of the horizontal support members. With the addition of suitable bearings (not shown) a series of independently rotatable carousel frames 8B' are mounted—one between each set of adjacent support members. As with the first embodiment the size of the bins 9' generally decreases in size toward the top of the frame as the number mounted on each carousel increases. Preferably as shown with this embodiment the lower two carousels are formed with corner flaps 19 and end flaps 20. This enables additional smaller bins 21, 22 to be mounted alongside the larger bins on these carousels.

Figure 8:
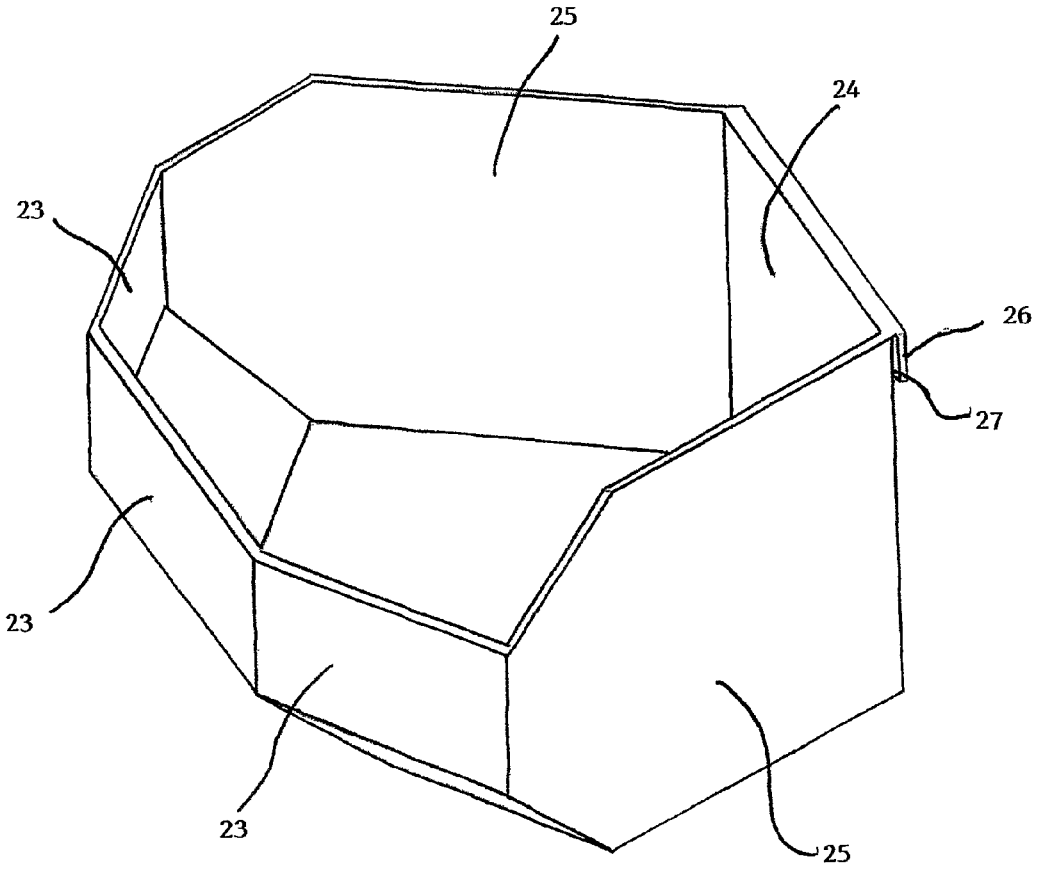
FIG. 8 shows a perspective view of a modified form of wedge shaped bin.

A modified form of wedge shaped bin for use with the aforementioned carousels is shown in FIG. 8. The rectangular bins as shown for example in FIG. 5 are inefficient when arranged in a circular or polygonal manner as they leave unused space at the front between the sides of adjacent bins. With the wedge shaped bin of FIG. 8 the front angled panels 23 are together wider than the back panel 24 so that the sides 25 are angled inwardly toward the rear. This reduces or substantially eliminates gaps between adjacent bins and maximises the storage space of the carousel. As with the rectangular bins described earlier there is a downwardly extending tongue 26 and slot 27 formed across the upper edge of the back panel 24 for engaging the carousel frame.

It will thus be appreciated that this invention at least in the form of the embodiment described provides a novel and improved form of holder for storage bins. Clearly however the example disclosed is only the currently preferred form of the invention and a variety of modifications may be made which would be apparent to a person skilled in the art.

For example:—

- The size, shape and configuration of the bins may be changed according to design preference.
- The design of the carousel support frames may also change according to installation requirements. They may for example be circular rectangular, or any other shape as required.
- The invention is not limited to any specific material for constructing the bins and carousel frames although plastic and/or metal is currently preferred.
- Each carousel may be injection moulded, with the storage bins formed as part of the carousel, or removable.
- The size of the complete storage carousel may vary according to individual requirements.
- The storage bins may be fixed to the carousels for safety.
- The carousels may be supplied individually, with their own central axis, such that they are in a modular form and can be built as required.

The invention claimed is:

1. A storage apparatus which includes multiple vertically displaced carousels with horizontal carousel frames independently rotatable about a common post mounted in an upright rectangular frame, said horizontal carousel frames having central hubs which fit over said common post and are rotatable thereon, said upright rectangular frame includes horizontal spaced apart support members with said horizontal carousel frames located one each between adjacent ones of said spaced apart support members, upstanding edges of said horizontal carousel frames removably mounting a plurality of storage bins with the size of said storage bins located toward a top of the storage apparatus being smaller than said storage bins located toward a bottom of the storage apparatus, wherein said upstanding edges of said horizontal carousel frames located towards said top of the storage apparatus mount a greater number of smaller ones of said storage bins than said horizontal carousel frames located towards said bottom of the storage apparatus and said smaller ones of said storage bins are wedge shaped and arranged on said horizontal carousel frames located towards the top of the storage apparatus side-by-side in a circular manner and the horizontal carousel frames of said horizontal carousel frames located towards the bottom of the storage apparatus have corner flanges and end flanges for mounting additional ones of said storage bins, said wedge-shaped bins when in a position of use each include front angled panels which together are wider than a back panel so that sides thereof are angled inwardly toward said back panel and a downwardly extending tongue and slot formed across an upper edge of said back panel to engage said upstanding edges of said frames.

2. The storage bin as claimed in claim 1 wherein the sides are angled inwardly to a degree which reduces or substantially eliminates gaps between adjacent one of said wedge shaped bins when arranged as part of a circle.

* * * * *